US010106946B2

(12) United States Patent
Mulderij

(10) Patent No.: US 10,106,946 B2
(45) Date of Patent: Oct. 23, 2018

(54) PILE UPENDING SYSTEM

(71) Applicant: IHC Holland IE B.V., Sliedrecht (NL)

(72) Inventor: Klaas-Jan Mulderij, Delft (NL)

(73) Assignee: IHC Holland IE B.V., Sliedrecht (NL)

( * ) Notice: Subject to any disclaimer, the term of this patent is extended or adjusted under 35 U.S.C. 154(b) by 0 days.

(21) Appl. No.: 15/534,001

(22) PCT Filed: Dec. 22, 2015

(86) PCT No.: PCT/NL2015/050899
§ 371 (c)(1),
(2) Date: Jun. 8, 2017

(87) PCT Pub. No.: WO2016/105193
PCT Pub. Date: Jun. 30, 2016

(65) Prior Publication Data

US 2017/0370068 A1 Dec. 28, 2017

(30) Foreign Application Priority Data

Dec. 23, 2014 (NL) ..... 2014049

(51) Int. Cl.
*E02D 27/42* (2006.01)

(52) U.S. Cl.
CPC ..... *E02D 27/42* (2013.01)

(58) Field of Classification Search
CPC ..... F16L 1/06; E21B 19/155
USPC ..... 405/231; 414/746.5, 746.8
See application file for complete search history.

(56) References Cited

U.S. PATENT DOCUMENTS 865,096 A * 9/1907 Foster ..... E21B 19/155 414/746.8
5,277,463 A * 1/1994 Singh ..... E21B 19/06 294/103.1
6,808,360 B1 * 10/2004 Patterson ..... B66C 1/66 294/89

FOREIGN PATENT DOCUMENTS

EP 334464 A2 9/1989
GB 2226539 A 7/1990
WO 2004038108 A1 5/2004

OTHER PUBLICATIONS

Dennis Denney, "Pile-Guding Tool", Journal of Petroleum Technology—Technology Applications, p. 4 and 5, http://www.spe. org/jpt/article/3070-technology-applications-8/.

* cited by examiner

*Primary Examiner* — Tara Mayo-Pinnock
(74) *Attorney, Agent, or Firm* — Lindsey A. Auerbach; Cathering A. Shultz; N.V. Nederlandsch Octrooibureau

(57) ABSTRACT

The invention relates to an upending system for an elongated tubular element like an offshore foundation pile or a turbine mast, the system comprising;

a pile frame for supporting a elongated tubular element, the pile frame comprising a pile support member for engaging a pile wall in order to avoid movement of the elongated tubular element with respect to the pile frame, and a coupling section, a support structure for supporting the pile frame, wherein the coupling section is rotatably supported by the support structure to allow rotation of the pile frame with respect to the support structure, wherein the support structure and the coupling section of the pile frame are configured such that the pile frame is detachably coupled to the support structure.

18 Claims, 7 Drawing Sheets

PILE UPENDING SYSTEM

BACKGROUND

The present invention relates to an upending system for an elongated tubular element like an offshore foundation pile or a turbine mast.

GB2226539 A discloses a system for offshore construction work wherein a pile is upended using two cranes one of which cranes is connected via a sling to one end of the pile and the other of which cranes is connected via a sling to two spaced apart connection points on the pile but whose line of action is to the other side of the centre of gravity (c) than the sling. A spreader bar maintains the separation between the connection points during upending. The sling is trained around a sheave so that both slings share the load of the pile equally during upending which is achieved by raising or lowering one sling relative to the other. The three point lift arrangement avoids excessive bending stress on the pile.

It is known to upend a pile offshore wherein an outboard end of a pile rests on a support where around the pile cants. During upending an outboard end is supported by a cable provided with a hook.

GB2394498 shows a pivoting frame for installing a wind turbine on a structure directly onto a submerged pile using an A-frame that can be moved using a winch-cable system. This frame is installed on a vessel on a predetermined fixed position which provides no flexibility during offshore operations.

Mono-piles, like for supporting a wind turbine, have a large diameter like up to 4 to 6 meters and may weigh hundreds of tonnes. These piles are transported from their production site, to for instance a wind turbine park, in a horizontal stance. These piles are finally used in a vertical stance. Therefore, these piles are upended from a horizontal to a vertical stance on site. This upending is a difficult task since such a pile is a thin walled structure and prone to local bending stresses. In addition, outboard operations in the proximity of the pile may be dangerous for personnel.

SUMMARY OF THE INVENTION

Therefore, the current invention aims to provide a pile upending system which is more flexible in use during operations.

Another object of the invention is to improve a prior pile upending system in that a problem associated therewith is at least partly solved.

Yet another object of the invention is to provide an alternative pile upending system.

According to a first aspect of the invention this is realized with an upending system for an elongated tubular element like an offshore foundation pile or a turbine mast, the system comprising;

- a pile frame for supporting an elongated tubular element, the pile frame comprising a pile support member for engaging a pile wall in order to avoid movement of the elongated tubular element with respect to the pile frame, and a coupling section,
- a support structure for supporting the pile frame, wherein the coupling section is rotatably supported by the support structure to allow rotation of the pile frame with respect to the support structure,
- wherein the support structure and the coupling section of the pile frame are configured such that the pile frame is detachably coupled to the support structure.

The support structure and the coupling section of the pile frame being configured such that the pile frame is detachably coupled to the support structure provides the possibility to position the pile frame at any desired position on a vessel or an offshore structure.

The pile frame being detachably coupled to the support structure means that the pile frame can be engaged with and taken off from the support structure with ease. The coupling between the support structure and the coupling section of the pile frame is regarded a temporary connection.

The pile frame being rotatably supported through its coupling section with respect to the support structure allows the pile frame in unity with an elongated tubular element to rotate in the so-called upending plane. The axis or rotation of the pile frame extend transverse with respect to the upending plane.

In an embodiment of the upending system, the pile frame is detachably coupled to the support structure in a hook on manner or in a clamping manner.

In an embodiment of the upending system, the coupling section is hingeably coupled with the support structure. This allows for the rotation of the pile frame with respect to the support structure.

In contrast, known upending systems use a big ball bearing. Stabilizing cylinders to stabilize the pile during upending are needed when a ball bearing is used. This is more expensive and it results in a rather large distance between the pile and the axis around which the pile rotates. In the upending system according to the invention, no stabilizing cylinders are needed because the coupling section in engagement with the support structure, in particular the rail, enables to provide a compact construction and therefore a very short distance between the pile and the axis of rotation of the pile frame. This results in more stability during pile upending.

It will be clear that as an alternative the support structure may comprise a hinge point and a hingeable member of the support structure is fixedly connected to the coupling section of the support frame.

In an embodiment of the upending system, the pile support member for engaging a pile wall is configured to avoid sidewards movement of the elongated tubular element.

In an embodiment of the upending system, the pile frame comprises a second pile support member coupled with the pile frame and able to engage a pile outboard end of an elongated tubular element for preventing sliding of the elongated tubular element along the pile frame.

In an embodiment, the upending system, comprises a pile frame drive system coupled with the pile frame and the support structure for rotating the pile frame between a substantially horizontal position and a substantially vertical position. The pile frame drive system may be directly coupled with the support structure or indirectly through structural members of e.g. a vessel or an offshore structure.

In an embodiment, the upending system comprises a support member drive system coupled with the second pile support member for driving the second pile support member between an extended position and a retracted position. This allows to handle piles of different lengths.

It is thinkable that the second pile support member comprises an attachment means like a pad eye. To this attachment means a chain or a cable can be attached. At the end of this cable or chain a hook can be placed. Although connecting of this hook to the outboard end of the pile will require outboard operations, it still enables to handle piles of increased length.

In an embodiment of the upending system, the support member drive system comprises a hydraulic cylinder, preferably a pair of hydraulic cylinders arranged on both sides of the second pile support member.

In an embodiment of the upending system, the support member drive system comprises a support member frame slideably coupled with the pile frame, and the second pile support member is arranged on the support member frame and moves in unity with the support member frame.

In an embodiment of the upending system, the support member frame is integrated with the pile frame. In this respect integrated means that the support member frame is partly accommodated within the pile frame depending on the actual position of the pile support member between the extended position and the retracted position. This provides a compact construction.

In an embodiment of the upending system, the support structure comprises a rail member for engagement with the coupling section of the pile frame. Such a rail member may easily extend along the circumference of a vessel. In addition, such a rail provides support to the pile frame along a considerable length which does improve stability of the pile during pending operations.

In an embodiment of the upending system, the coupling section of the pile frame comprises a number of hook members for engagement with the support structure.

The rail, in particular in combination with the coupling section comprising a number of hooks, provides support to the pile frame along a considerable length which does improve stability of the pile during pending operations.

In an embodiment of the upending system, the coupling section is hingeably arranged with respect to the pile frame to allow the pile frame to move sidewards out of an upending plane. In addition, this allows to hinge the pile frame away from the water surface when the upending system is not in use.

The invention further relates to an offshore structure or vessel comprising an upending system according to the invention.

In an embodiment of the offshore structure or vessel, the support structure extends along the circumference of the offshore structure or vessel to enable engagement of the pile frame at any desired position.

The invention further relates to the use of an upending system according to the invention, the use comprising;

coupling the pile frame with the support structure, upending an elongated tubular element, and detaching the pile frame from the support structure.

In an embodiment, the use comprises;

extending the second frame support member to the extended position, loading an elongated tubular element on the pile frame, retracting the second frame support member until the second frame support member contacts an outboard end of the elongated tubular element, The invention further relates to a device comprising one or more of the characterising features described in the description and/or shown in the attached drawings.

The invention further relates to a method comprising one or more of the characterising features described in the description and/or shown in the attached drawings.

The various aspects discussed in this patent can be combined in order to provide additional advantageous advantages.

DESCRIPTION OF THE DRAWINGS

The invention will be further elucidated referring to an preferred embodiment shown in the drawings, wherein shown in.

DETAILED DESCRIPTION OF EMBODIMENTS

Figure 1:
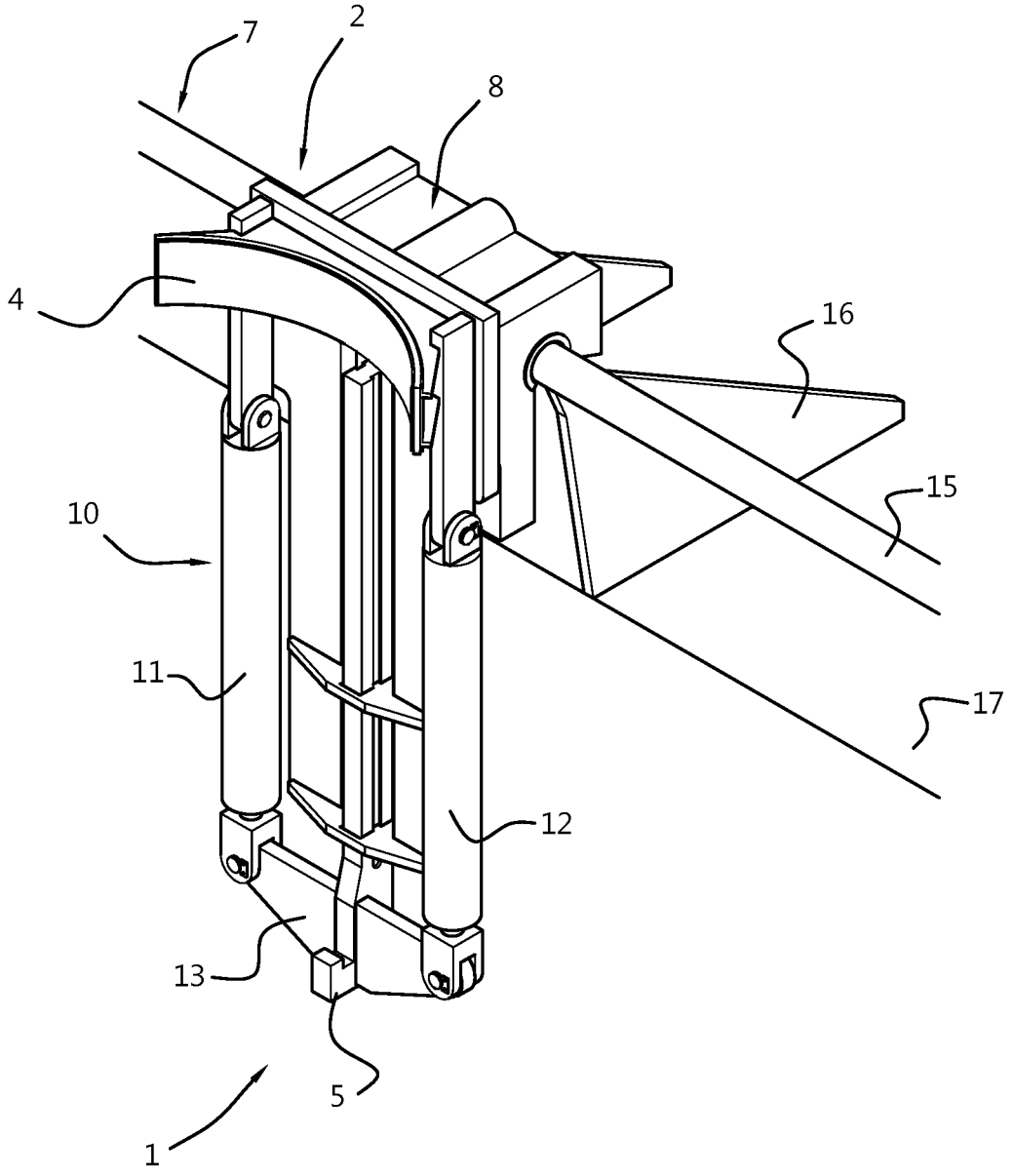
FIG. 1 in perspective view an upending system according to the invention in a substantially vertical position.

FIG. 1 shows in perspective view an upending system 1 according to the invention in a substantially vertical position. The upending system 1 is suitable to upend an elongated tubular element 3 like an offshore foundation pile or a turbine mast. The upending system 1 comprises a pile frame 2 for supporting a elongated tubular element.

The pile frame comprises a pile support member 4. The pile support member 4 for engaging a pile wall 6 is configured to avoid sidewards movement of the elongated tubular element 3. The pile support member 4 has a curved shape that corresponds with the pile wall 6. The pile support member 4 engages the pile wall 6 in order to avoid any unwanted movement of the elongated tubular element with respect to the pile frame 2.

The upending system 1 comprises a support structure 7 for supporting the pile frame 2. The support structure may be mounted on a deck 17 of a vessel (partly shown) or any other offshore structure that needs an upending system.

The pile frame 2 comprises a coupling section 8. The pile frame 2 is coupled with the support structure 7 through the coupling section 8. The coupling section 8 is rotatably supported by the support structure 7 to allow rotation of the pile frame 2 with respect to the support structure 7.

The support structure 7 and the coupling section 8 of the pile frame 2 are configured such that the pile frame 2 is detachably coupled to the support structure 7.

In this case the pile frame 2 is detachably coupled to the support structure 7 in a hook on manner. Therefore, the coupling section 8 comprise a hook member 14 or a number of hook members 14. The support structure comprises a rail member 15. The rail member 15 is suitable for engagement with the coupling section 8 of the pile frame 2. The hook member 14 is suitable for engagement with the rail 15 of the support structure 7. The rail member 15 extends along the circumference of the vessel to enable to position the pile frame 2 at a desired location. The rail member 15 is mounted on the deck 17 through rail support members 16.

Here, the hook member 14 hooked on the rail member 15 ensures that the coupling section 2 is hingeably coupled with the support structure. Therefore, the pile frame 2 is able to rotate.

The pile frame 2 comprises a second pile support member 5 coupled with the pile frame 2. The second pile support member 5 is able to engage a pile outboard end 6 of an elongated tubular element 3 for preventing sliding of the elongated tubular element along the pile frame 2.

Figure 3:
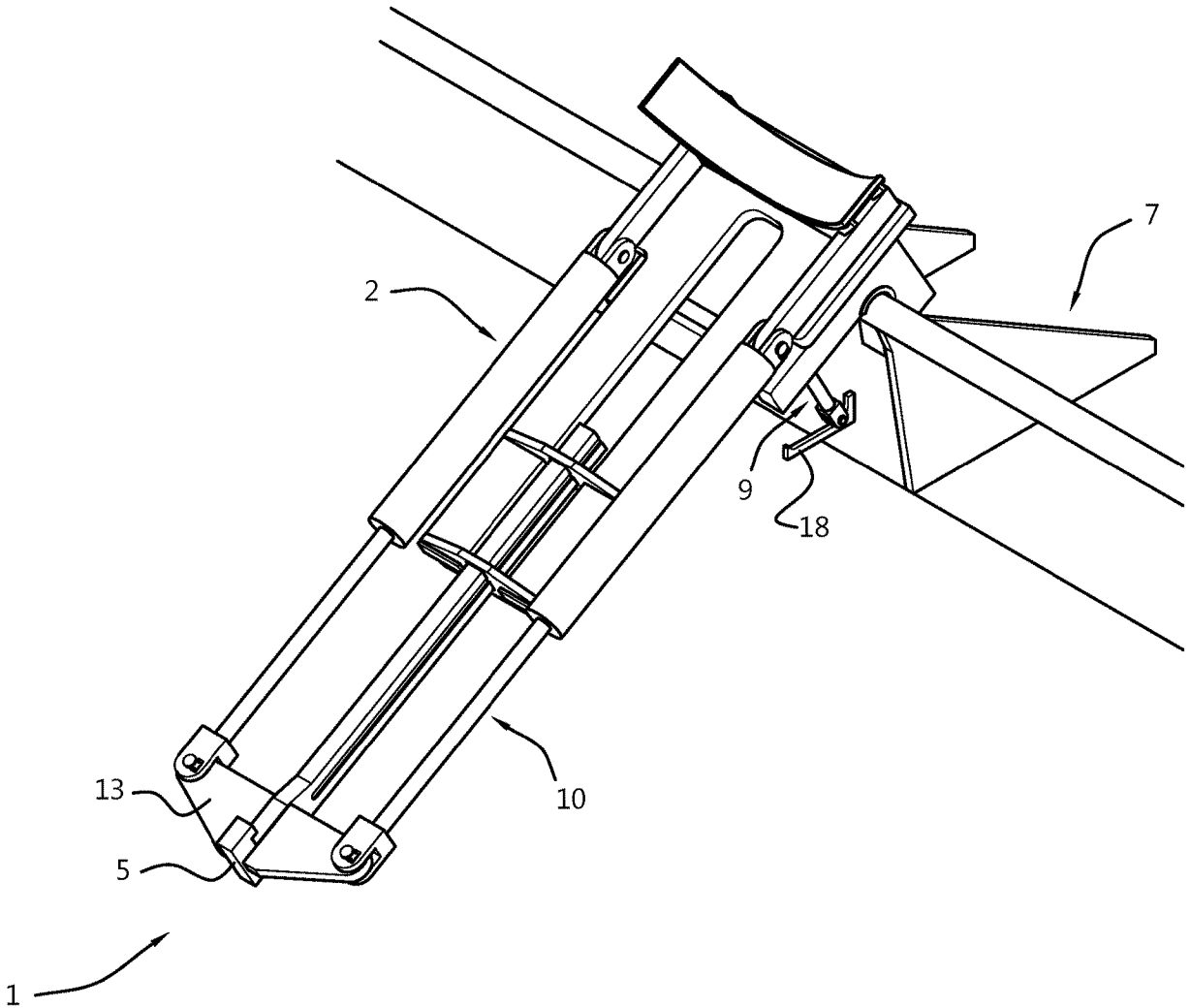
FIG. 3 the upending system according to FIG. 1 where the pile frame is in a position between a substantially horizontal position and a substantially vertical position.
Figure 4:
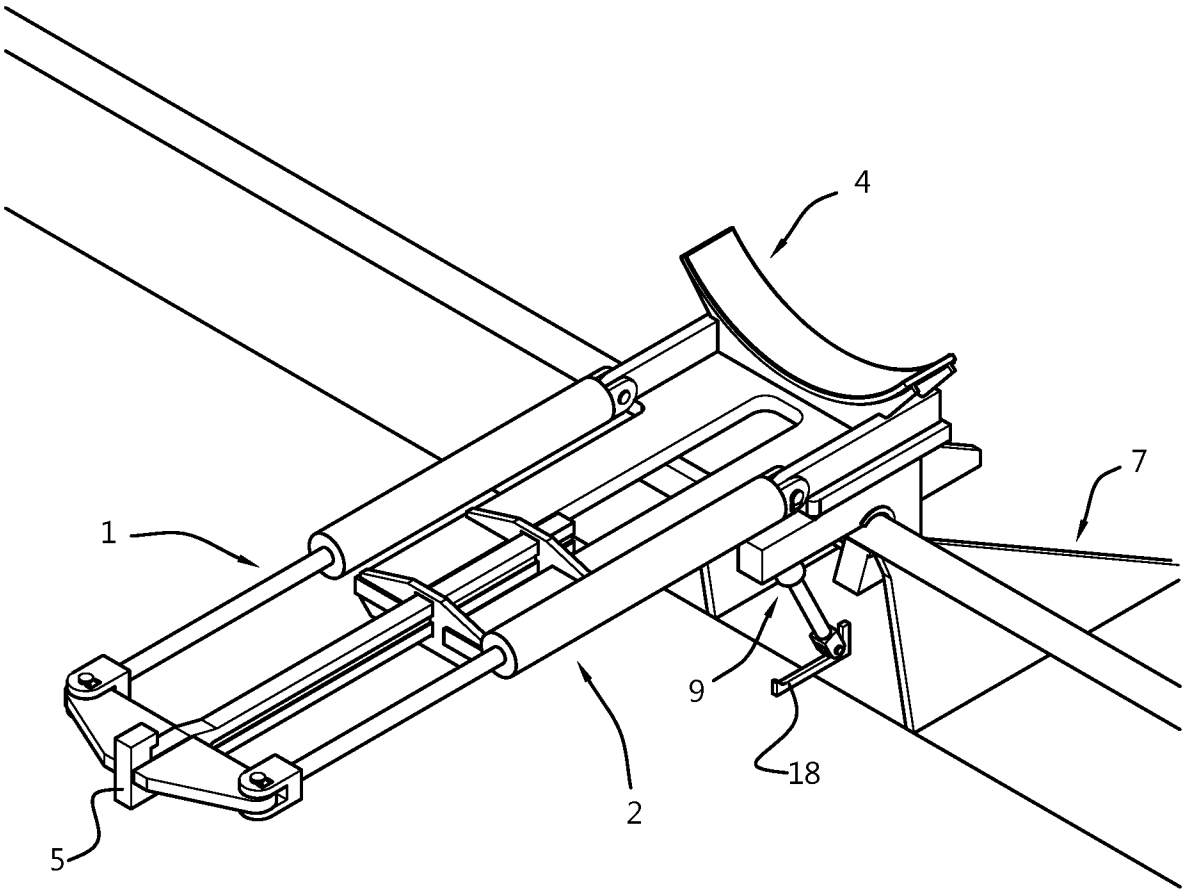
FIG. 4 the upending system according to FIG. 1 where the pile frame is in a substantially horizontal position.

The upending system 1 comprises a pile frame drive system 9 as shown in FIG. 3. In this case, the pile frame drive system 9 is a hydraulic cylinder. The pile frame drive system 9 is coupled with the pile frame 2 and the support structure 7 for rotating the pile frame 2 between a substantially horizontal position (FIG. 4) and a substantially vertical position (FIG. 1). Here, the pile frame drive system 9 is coupled with the support structure 7 through a guiding member 18. The guiding member 18 receives an end of the pile frame drive system 9 and provides a stop therefore. During use of the pile frame drive system 9, the pile frame drive system 9 is extended. The guiding member 18 which extends outboard, receives or catches the leading end 25 of the pile frame drive system 9. To this leading end a wheel member is mounted to guide the leading end to the end of the guiding member. When the wheel hits the stop at the end of the rails the pile frame 2 is lifted until the second pile support member 5, that is the hook, is in position to engage the pile. The hook is then retracted until it touches the pile, see FIG. 5.

The upending system 1 comprises a support member drive system 10. The support member drive system 10 is coupled with the second pile support member 5. The support member drive system 10 drives the second pile support member between an extended position (FIG. 2) and a retracted position (FIG. 1).

In this case, the support member drive system 10 comprises a pair of hydraulic cylinders 11, 12. The hydraulic cylinders 11, 12 are arranged on both sides of the second pile support member 5. This arrangement of the hydraulic cylinders provides a stable support of the elongated tubular element 3.

The support member drive system 10 comprises a support member frame 13. The second pile support member 5 is mounted on the support member frame 13 and moves in unity with the support member frame. The support member frame 13 is slideably coupled with the pile frame 2. The hydraulic cylinders 11, 12 are coupled with the pile frame 2 and the support member frame 13 for moving the second pile support member 5.

Figure 6:
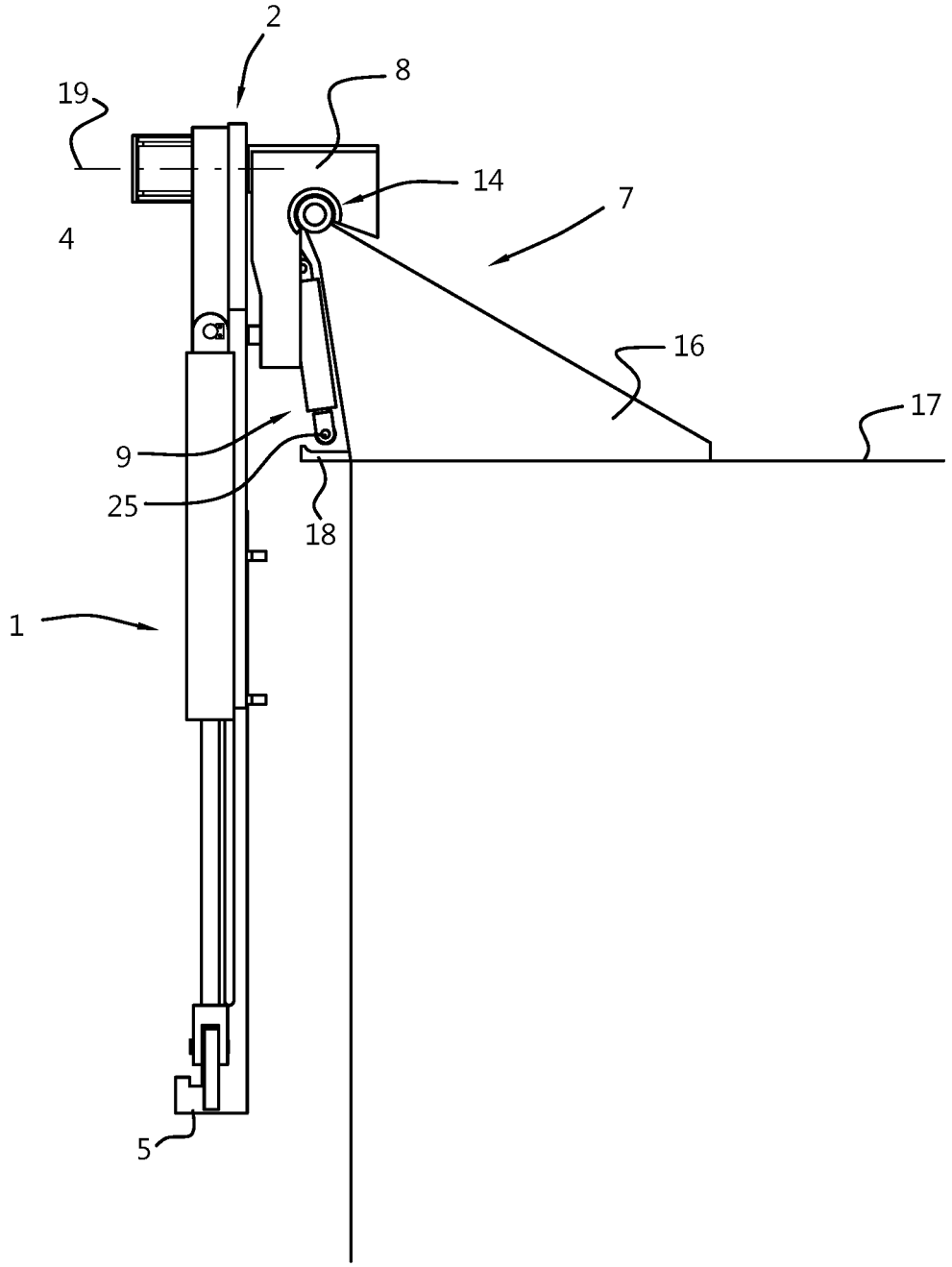
FIG. 6 a side view of the upending system according to FIG. 1.
Figure 7:
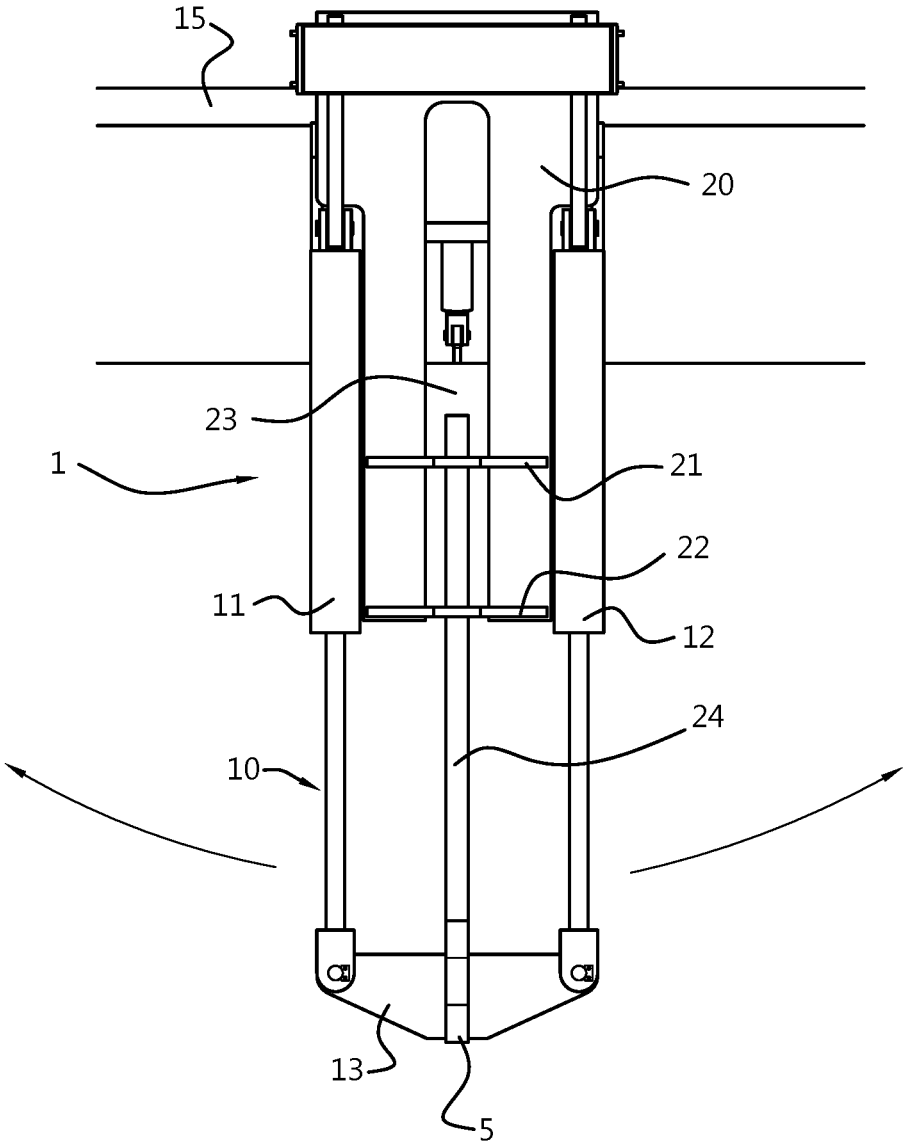
FIG. 7 a front view of the upending system according to FIG. 1.

As can be seen in FIG. 6, the coupling section 8 may be hingeably arranged with respect to the pile frame 2 to allow the pile frame to move sidewards out of an upending plane, as shown with arrows in FIG. 7. The pile frame may hinge sidewards out of the upending plane around hinge axis 19.

The support member frame 13 is integrated with the pile frame as shown in FIG. 7. The support member frame 13 comprises a carrying beam 24 that is mounted to the pile frame 2 through support members 21, 22. The carrying beam 24 is able to slide with respect to the support members 21, 22. The carrying beam 24 slides in and out a carrying beam accommodation 23 formed within a pile frame body 20.

Figure 2:
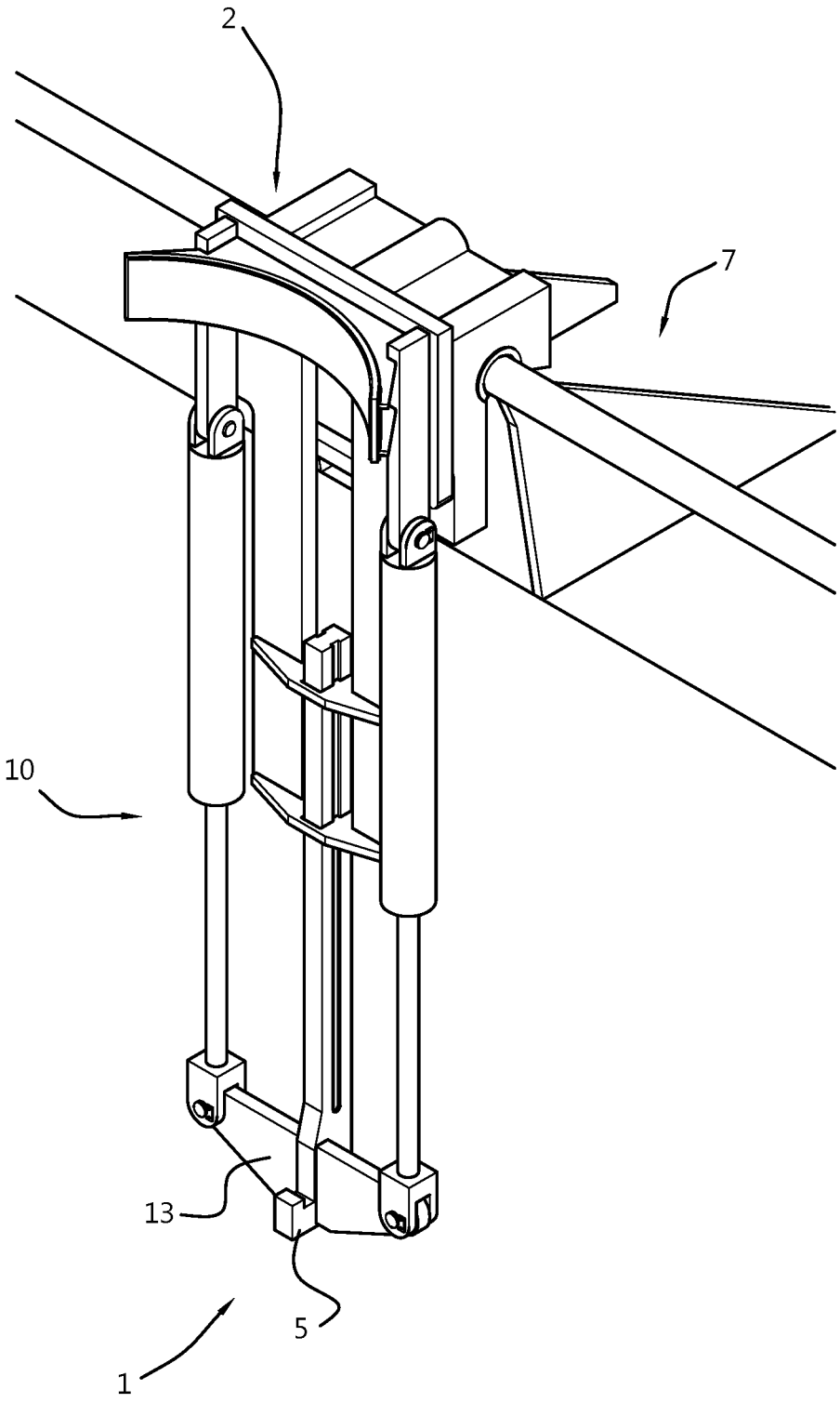
FIG. 2 the upending system according to FIG. 1, wherein a pile support member is in its extended position.
Figure 5:
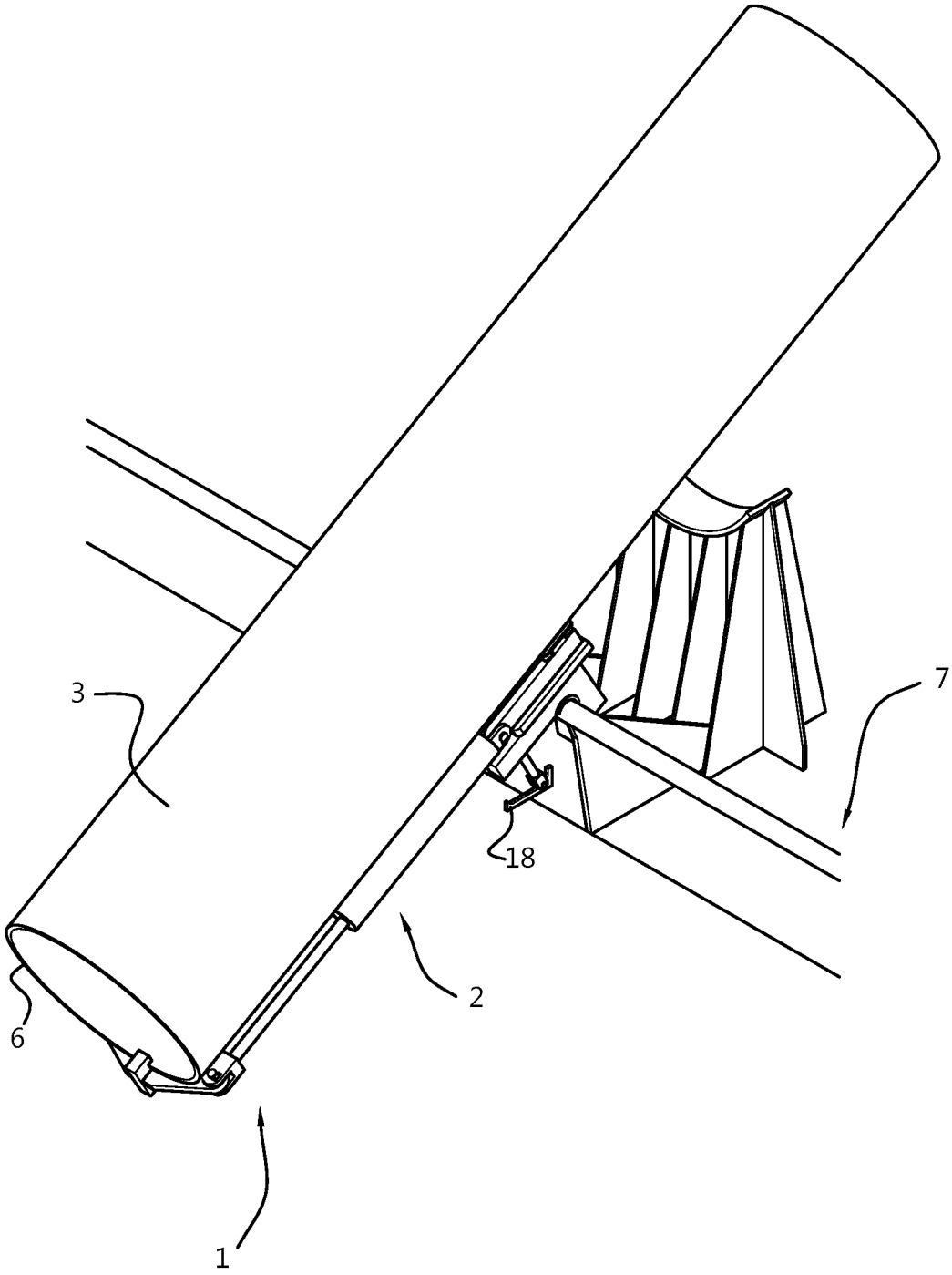
FIG. 5 the upending system according to FIG. 1, while upending a pile.

During use of an upending system 1 the following steps are taken: First coupling the pile frame 2 to the support structure 7. Subsequently upending of an elongated tubular element 3, and then detaching the pile frame 2 from the support structure 7. In addition, following steps may be included: Extending the second frame support member to the extended position (FIG. 2). Loading an elongated tubular element 3 on the pile frame 2. FIG. 5 shows an elongated tubular element 3 loaded on the pile frame 2. Retracting the second frame support member 5 until the second frame support member contacts an outboard end 6 of the elongated tubular element 3.

It will also be obvious after the above description and drawings are included to illustrate some embodiments of the invention, and not to limit the scope of protection. Starting from this disclosure, many more embodiments will be evident to a skilled person which are within the scope of protection and the essence of this invention and which are obvious combinations of prior art techniques and the disclosure of this patent.

The invention claimed is:

1. Upending system for an elongated tubular element, the system comprising;

a pile frame for supporting an elongated tubular element, the pile frame comprising a pile support member for engaging a pile wall in order to avoid movement of the elongated tubular element with respect to the pile frame, and a coupling section, a support structure for supporting the pile frame, wherein the coupling section is rotatably supported by the support structure to allow rotation of the pile frame with respect to the support structure, wherein the support structure and the coupling section of the pile frame are configured such that the pile frame is detachably coupled to the support structure.

2. Upending system according to claim 1, wherein the pile frame is detachably coupled to the support structure in a hook on manner or in a clamping manner.

3. Upending system according to claim 1, wherein the coupling section is hingeably coupled with the support structure.

4. Upending system according to claim 1, wherein the pile support member for engaging a pile wall is configured to avoid sidewards movement of the elongated tubular element.

5. Upending system according to claim 1, wherein the pile frame comprises a second pile support member coupled with the pile frame and able to engage a pile outboard end of an elongated tubular element for preventing sliding of the elongated tubular element along the pile frame.

6. Upending system according to claim 1, comprising a pile frame drive system coupled with the pile frame and the support structure for rotating the pile frame between a substantially horizontal position and a substantially vertical position.

7. Upending system according to claim 1, comprising a support member drive system coupled with the second pile support member for driving the second pile support member between an extended position and a retracted position.

8. Upending system according claim 7, wherein the support member drive system comprises a hydraulic cylinder.

9. Upending system according to claim 7, wherein the support member drive system comprises a support member frame slideably coupled with the pile frame, and the second pile support member is arranged on the support member frame and moves in unity with the support member frame.

10. Upending system according to claim 9, wherein the support member frame is integrated with the pile frame.

11. Upending system according claim 7, wherein the support member drive system comprises a pair of hydraulic cylinders arranged on both sides of the second pile support member.

12. Upending system according to claim 1, wherein the support structure comprises a rail member for engagement with the coupling section of the pile frame.

13. Upending system according claim 1, wherein the coupling section of the pile frame comprises a number of hook members for engagement with the support structure.

14. Upending system according claim 1, wherein the coupling section is hingeably arranged with respect to the pile frame to allow the pile frame to move sidewards out of an upending plane.

15. Offshore structure or vessel comprising an upending system according to claim 1.

16. Offshore structure or vessel according to claim 15, wherein the support structure extends along the circumference of the offshore structure or vessel.

17. A method for upending an elongated tubular element system according to claim 1, the method comprising;

coupling the pile frame with the support structure, upending an elongated tubular element, and detaching the pile frame from the support structure.

18. The method according to claim 17, and further comprising;

extending the second frame support member to the extended position, loading an elongated tubular element on the pile frame, and retracting the second frame support member until the second frame support member contacts an outboard end of the elongated tubular element.

* * * * *